US009464450B2

(12) United States Patent
McDowell, Jr. et al.

(10) Patent No.: US 9,464,450 B2
(45) Date of Patent: Oct. 11, 2016

(54) AUTOMATIC PARKING STRUCTURE

(75) Inventors: Joseph Coleman McDowell, Jr., Flower Mound, TX (US); Michael Corbett Story, Grand Prairie, TX (US); James Bowmer Story, Highland Village, TX (US); Dwayne David Miller, Northville, MI (US); Sean Patrick Laney, Trenton, MI (US); Daniel Jordan Reece, Woodhaven, MI (US)

(73) Assignee: SAFE PARKING LIMITED, Katy, TX (US)

( * ) Notice: Subject to any disclaimer, the term of this patent is extended or adjusted under 35 U.S.C. 154(b) by 1279 days.

(21) Appl. No.: 13/127,671

(22) PCT Filed: Nov. 9, 2009

(86) PCT No.: PCT/US2009/063757

§ 371 (c)(1),
(2), (4) Date: May 22, 2012

(87) PCT Pub. No.: WO2010/054335

PCT Pub. Date: May 14, 2010

(65) Prior Publication Data

US 2013/0142599 A1 Jun. 6, 2013

Related U.S. Application Data

(60) Provisional application No. 61/112,432, filed on Nov. 7, 2008.

(51) Int. Cl.

| | |
|---|---|
| ***E04H 6/00*** | (2006.01) |
| ***E04H 6/30*** | (2006.01) |
| ***E04H 6/18*** | (2006.01) |

(52) U.S. Cl.
CPC ..... *E04H 6/305* (2013.01); *E04H 6/183* (2013.01)

(58) Field of Classification Search
USPC ..... 414/256, 235, 239, 241, 253
See application file for complete search history.

(56) References Cited

U.S. PATENT DOCUMENTS

| | | | | |
|---|---|---|---|---|
| 4,588,048 | A | 5/1986 | Rodriguez | |
| 5,314,284 | A | 5/1994 | Tsai | |
| 7,143,869 | B1 | 12/2006 | Chance | |
| 2002/0146305 | A1 | 10/2002 | Haag | |
| 2005/0045429 | A1 | 3/2005 | Baker | |
| 2008/0031711 | A1* | 2/2008 | Yook | E04H 6/183 414/253 |

FOREIGN PATENT DOCUMENTS

WO WO 2008/045606 A1 4/2008

OTHER PUBLICATIONS

PCT International Search Report mailed on Dec. 29, 2009 for PCT/US2009/063757.

* cited by examiner

*Primary Examiner* — Saul Rodriguez
*Assistant Examiner* — Wilie Berry, Jr.
(74) *Attorney, Agent, or Firm* — Andrew W. Chu; Craft Chu PLLC

(57) ABSTRACT

A mechanism for moving vehicles within a vehicle parking structure comprises a lift platform which can be moved vertically and laterally to positions in register with one or more transfer rooms through which vehicles enter and leave the structure and a selected parking space of the structure. A vehicle transfer mechanism is carried on the platform and includes four self-powered tractors carrying lift arms that can be driven off the platform to engage the tires of a vehicle and to transfer that vehicle onto the platform for transportation between a transfer room and a parking space. The tractors, when deployed, pass outside the vehicle tires with the lift arms folded and can then be operated to extend the arms in a way that engages the tires and lifts the vehicle.

11 Claims, 18 Drawing Sheets

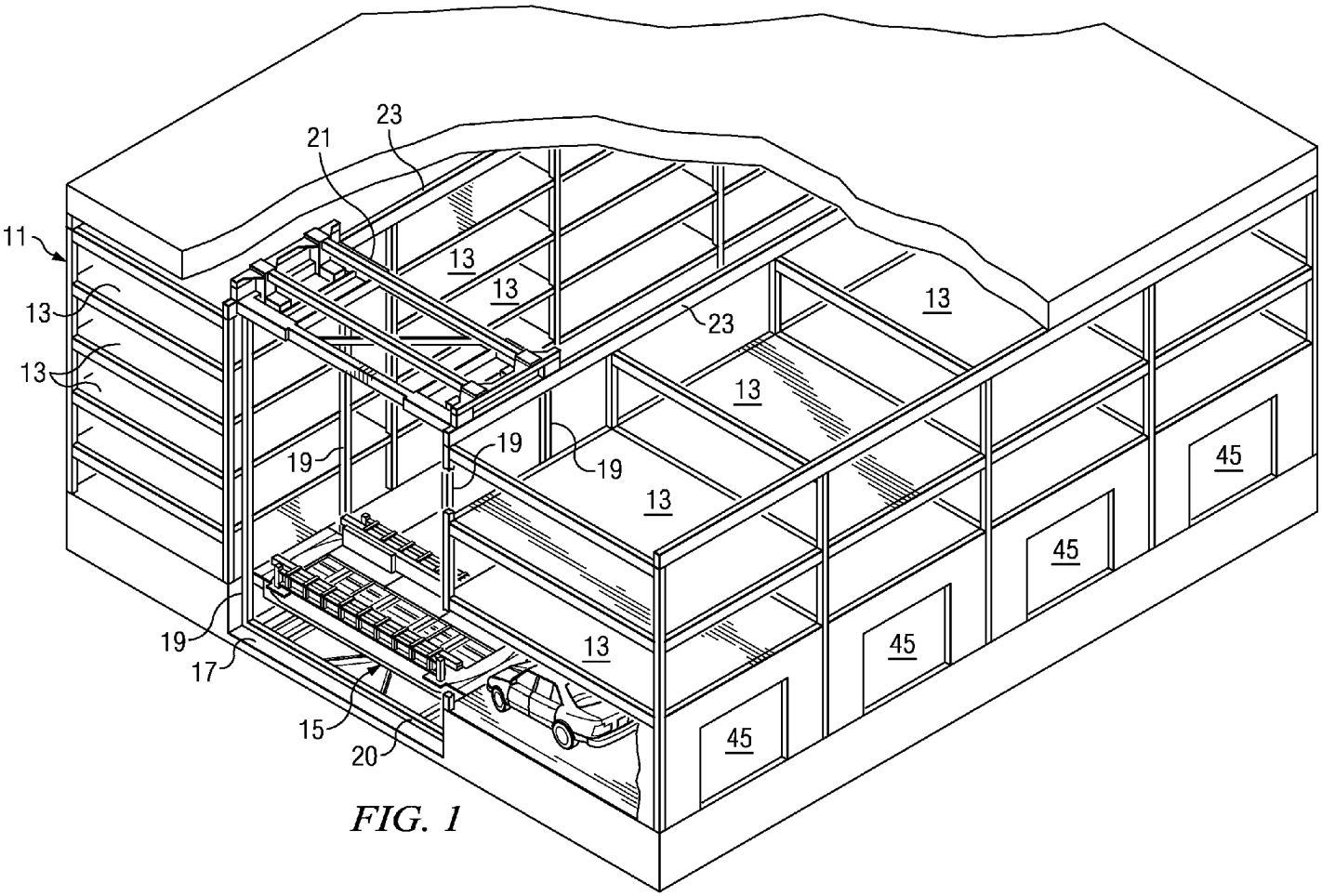
11
13
13
13

AUTOMATIC PARKING STRUCTURE

FIELD OF THE INVENTION

The invention relates to structures, and systems used for storing and retrieving articles, such as passenger vehicles.

BACKGROUND OF THE INVENTION

In many real estate developments, the space required to park passenger vehicles is a large part of the cost. It is desirable to minimize this cost. An automated parking structure in which vehicles are parked in close proximity without the space needed to open and close doors or for people to enter or exit the vehicles can increase the number of vehicles parked in a given volume or surface footprint. Such structures may use vehicle moving equipment to pick and place the vehicles into parking slots. These structures usually require that various parts of the parking structure, including the transfer room(s) through which the vehicles enter and leave the parking structure, have fixed elements that, in these designs, are required to interact with some form of vehicle moving equipment. For example, some automated parking structures require that the transfer room have a floor with one or more open slots through which parts of a vehicle transfer apparatus can pass. In these systems, the vehicle moving equipment is thicker than the space allowed by the vehicle ground clearance. Slots are therefore required to enable the prior vehicle moving equipment to pass under the vehicle body so that it may engage the vehicle without damaging its bodywork. Similar slots are then required in the parking storage space to allow the vehicle to be placed there by the prior vehicle moving equipment. These slots, grooves and similar accommodations add cost and complexity to the parking structure. Further, they make it difficult to change the size of a parking space as the slots, grooves or other accommodations are often integral with the fixed floor and can not be moved or easily modified. Finally, the addition of slots, grooves and similar accommodations may increase the thickness of each parking floor, thereby potentially reducing the number of parking floors possible in a structure of a given height. However, as vehicle demographics change, it may be desirable for a garage operator to be able to either widen or narrow the parking spaces to maximize revenue at that facility or adjust to a change in the size mix of vehicles using the facility.

Pending International Patent Application PCT/US2007/072938, International Publication Number WO 2008/045606 (the "International Publication"), describes certain structures and methods for use in the automatic parking of vehicles in a parking structure comprising a series of vertically spaced floors providing parking spaces for the vehicles. The contents and disclosures of International Publication Number WO 2008/045606 are incorporated herein by reference.

The structure described in detail with reference to FIG. 1 in the International Publication includes a vehicle transporter 18, a lifting platform 26 and a dolly 30. As shown in FIGS. 5-13 of the International Publication, the dolly 13 is dimensioned and arranged to pass underneath the vehicle to be parked and between that vehicle's wheels. Four pairs of engagement arms 64a-64d carried by the dolly can be inserted under the vehicle and deployed to engage the tires of the vehicle and to lift the vehicle from the floor of the parking structure for movement onto or off the platform 18.

SUMMARY OF THE INVENTION

The present invention relates to an improved arrangement for transporting vehicles in a parking structure between a lift platform and a parking space. In particular, the arrangement includes tire engaging arms which engage the tires of the vehicle to be lifted from outside the vehicle.

According to the present invention, in one aspect, there is provided apparatus for transporting a vehicle between a lift platform and a parking space of a parking structure comprising four tractors, two on each side of the platform, adapted for motion between the platform and the parking space, each tractor carrying a pair of opposed tire engaging lift arm assemblies adapted to engage a tire of the vehicle to be transported and to lift the vehicle for movement onto or off of the platform or parking space, the tractors being arranged to pass outside the tires of the vehicle with the lift arms in a folded condition and then to extend the arms to engage and lift a respective tire.

In a further aspect, the present invention provides apparatus for transporting a vehicle between the vertically and horizontally spaced parking spaces provided on two spaced apart, parallel arrays of vertically spaced parking floors of a parking structure and one or more transfer rooms of the structure comprising a pair of rails disposed above the top floor of the structure and extending the length of the structure, an upper frame mounted on the rails for movement along the length of the structure, a lift supported by the upper frame which can be raised or lowered to a selected vertical position corresponding to a particular parking floor of the structure, a mast structure extending between the upper frame and a lower frame, the lower frame carrying position maintaining guides that hold the mast structure in a vertical condition by engagement with a rail mounted on the lower surface of the structure, and a drive adapted to move the mast structure longitudinally between the two arrays of parking floors.

BRIEF DESCRIPTION OF THE DRAWINGS

A preferred form of the invention will now be described, by way of example only, with reference to the accompanying drawings, in which:

FIG. 1 is a schematic representation of a parking structure with an arrangement for transporting vehicles embodying the present invention;

Figure 1A:
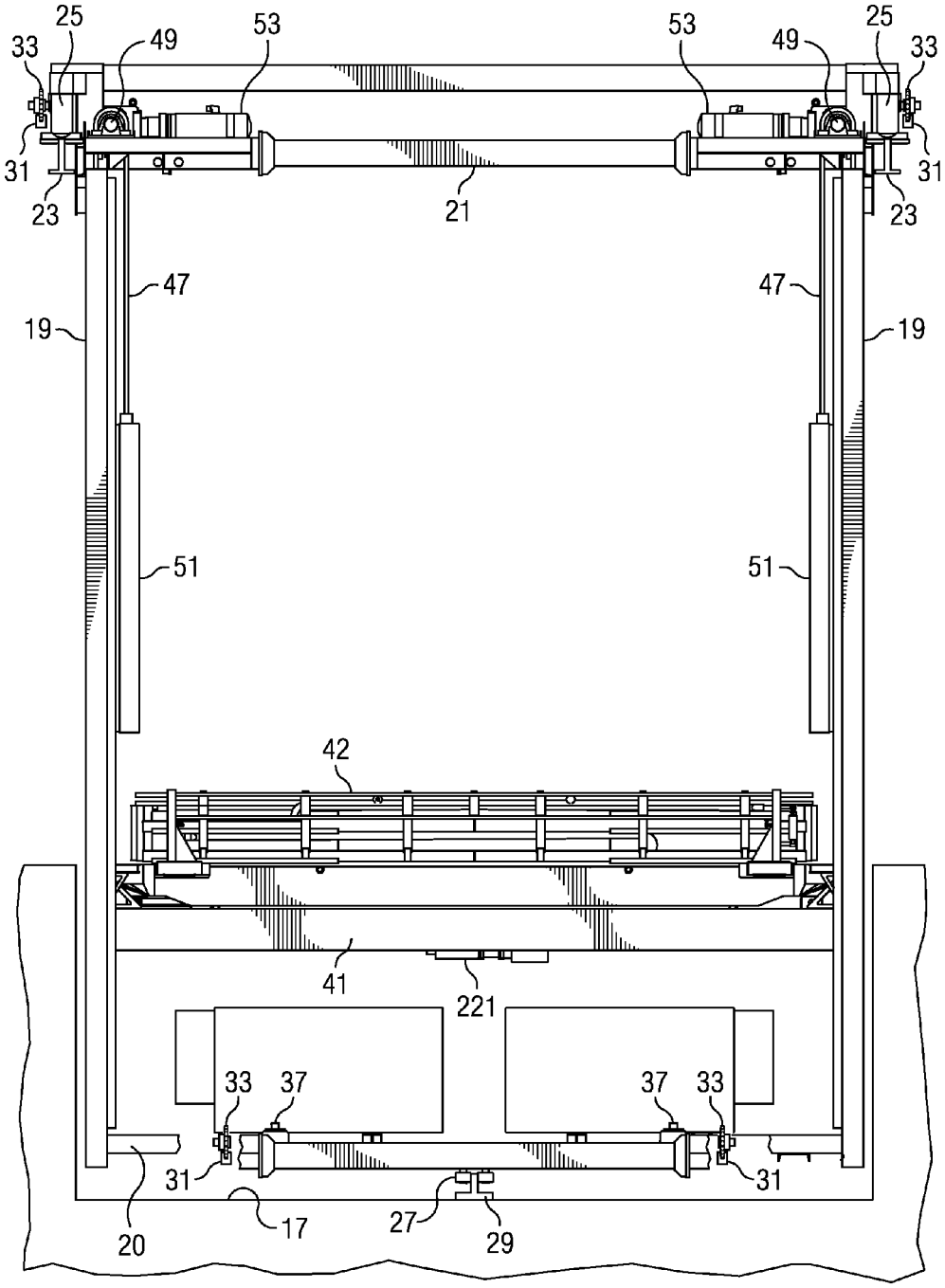
FIG. 1*a* is an end elevation of the arrangement shown in FIG. 1.

In the drawings, some parts are omitted for clarity.

DETAILED DESCRIPTION

FIG. 1 shows the general arrangement of a preferred form of vehicle parking structure and mechanism. The structure comprises two arrays of vertically-spaced parking floors 11 each of which provide a plurality of laterally spaced parking spaces 13. The two arrays are spaced apart and a vehicle transporter 15 is disposed between them. The vehicle transporter 15 travels longitudinally between the two arrays in a trench 17, which is below the floor level of the structure.

The vehicle transporter 15 comprises a mast structure comprising four vertical masts 19 extending the vertical height of the parking floor arrays and disposed at the corners of a rectangle. A lower frame 20 connects the masts 19 at their lower ends, and an upper frame 21 connects the masts 19 at their upper ends. The mast structure is suspended from a pair of horizontal crane rails 23 that extend the length of the parking structure, and are supported by the parking structure. The upper frame 21 of the mast structure is mounted on two pairs of rollers 25 located outside the top of the masts 19 at the two sides of the frame 21 that are supported on the crane rails 23 and allow the mast structure to travel along the crane rails 23 to a position horizontally aligned with a selected parking space 13.

The lower frame 20 is spaced above the floor of the trench 17 and the vertical orientation of the mast structure is maintained during motion by means of pairs of rollers 27 on the bottom of the lower frame 20 that are engaged on either side of a rail 29 mounted on the floor of the trench 17 and extending the length of the trench 17.

Two spaced apart stationary chains 31 extend the length of the trench 17 and are secured at their ends to the structure. The chains 31 are engaged by sprockets 33 of gear boxes driven by respective motors 37 carried on the lower frame 20. The upper frame 21 of the mast structure also carries two motors 37 connected, via gear boxes, to sprockets 33 that engage stationary chains 31 located outside the masts 19 at the two sides of the frame 21 and extending the length of the parking structure. Operation of the motors 37 cause the sprockets 33 to turn and their engagement with the respective stationary chains 31 imparts motion to the mast structure to move it along the trench 17.

Associated with the mast structure is a lift 39 comprising a platform 41 which can be raised and lowered vertically with respect to the mast structure. A vehicle-carrying deck 42 is mounted on the platform 41 and can be rotated about a vertical axis in the manner described below. A vehicle transfer mechanism 43 adapted to move a vehicle from a transfer room 45 or a parking space 13 onto the deck 42 is mounted on the deck 42. The deck 42 is essentially rectangular and the terms "longitudinal" and "transverse" will be used in this description to refer to the direction parallel to the longer sides of the rectangle and the direction perpendicular to the longer sides.

The platform 41 is supported at its four corners by lift chains 47 that extend over pulleys 49 on the upper frame 21 of the mast structure. One end of each chain 47 is connected to the platform 41 and the other end to a counter-weight 51. The chains are driven by motors 53 to raise and lower the platform 41. The weight of the platform 41 and of a vehicle on the deck 42 is supported not by the mast structure, which is suspended from the crane rails 23, but by the building structure itself, which supports the crane rails 23.

Figure 2:
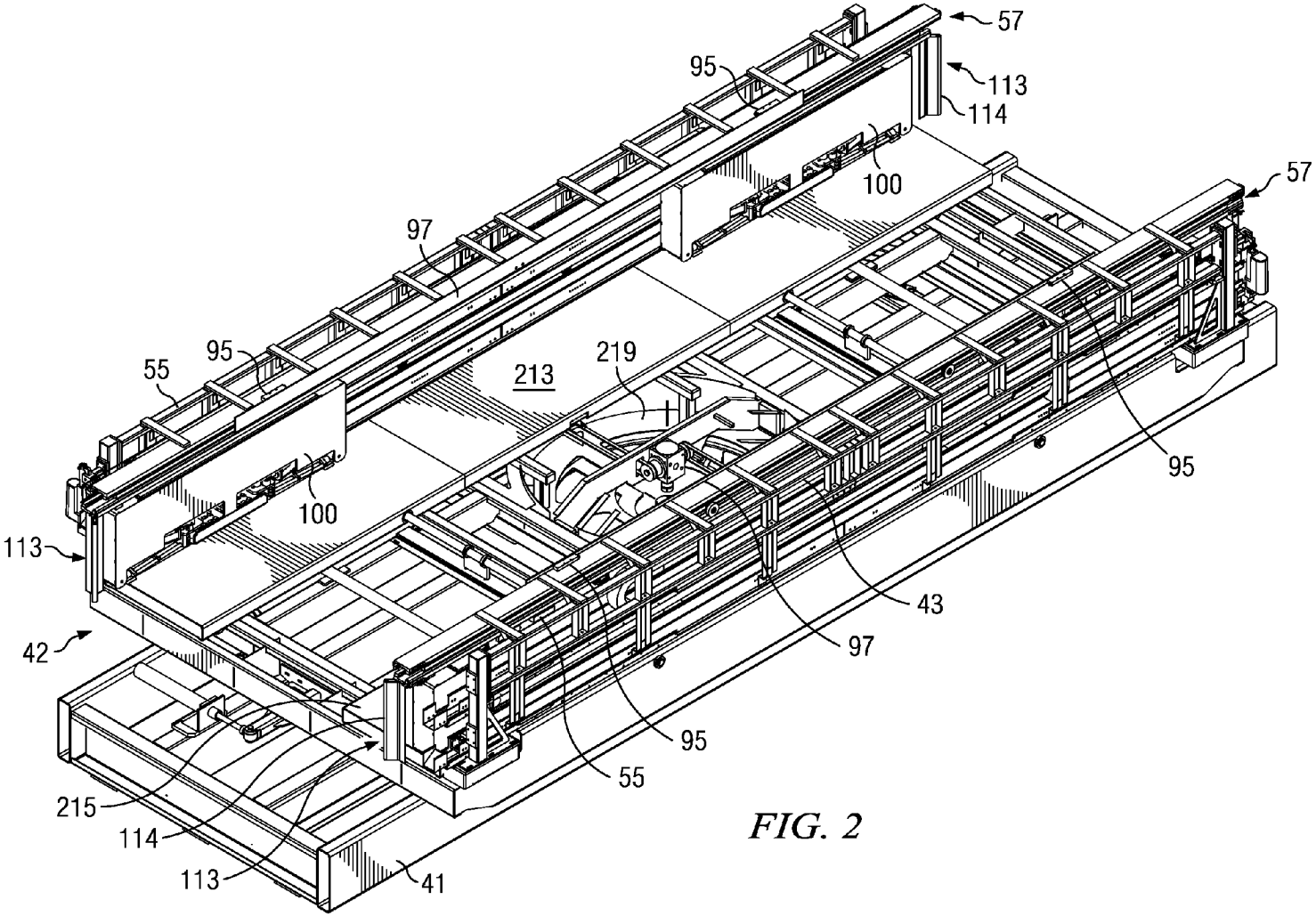
FIG. 2 is a schematic representation showing the platform, slide assemblies, tractors and lift arm assemblies of the arrangement shown in FIG. 1.
Figure 3:
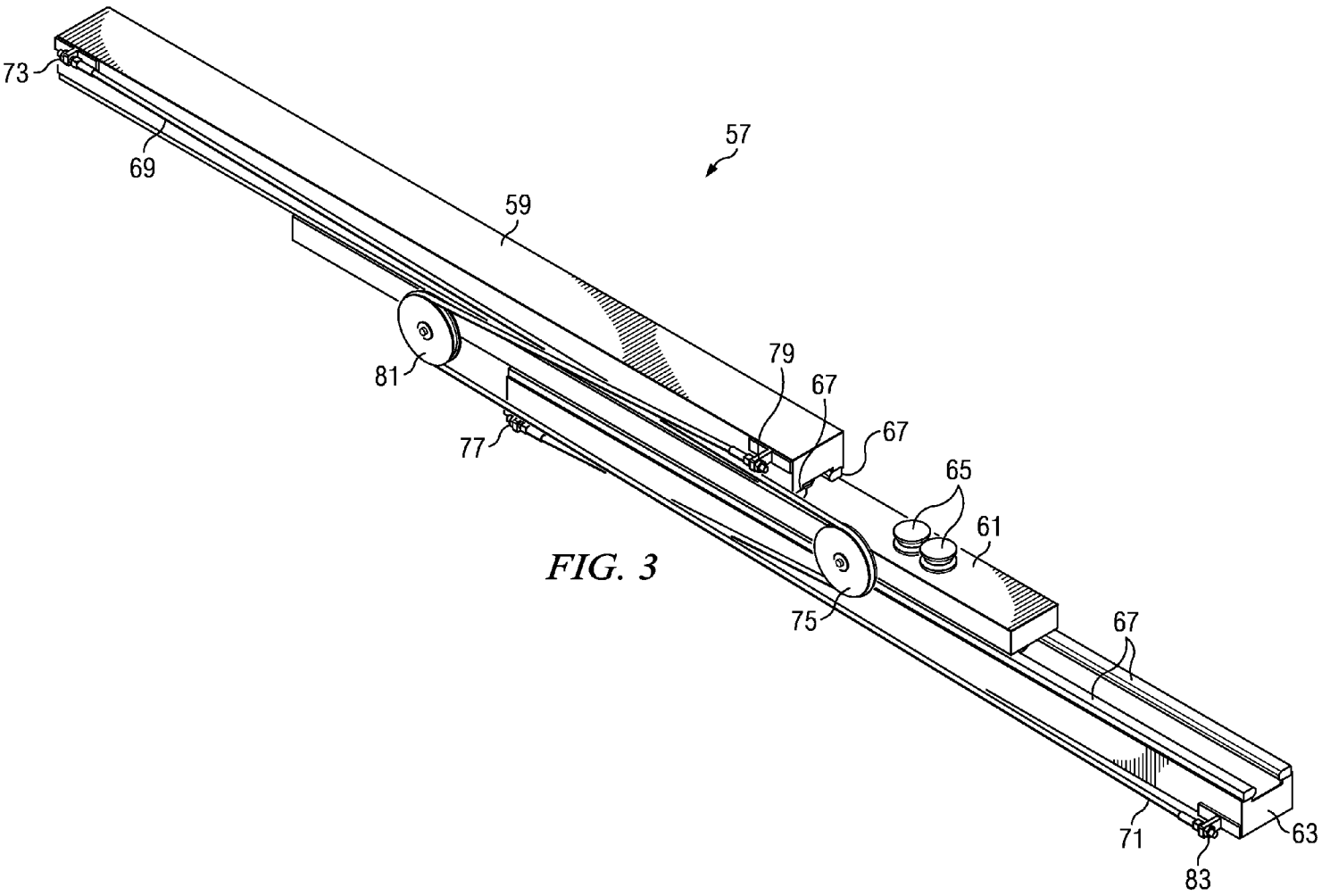
FIG. 3 is a perspective view of one of the slide assemblies.

FIGS. 2 through 10 show the vehicle transfer mechanism 43 in detail. The mechanism 43 comprises two essentially similar assemblies on each side of the platform 41. A support frame 55 is provided on each of the longer sides of the platform 41 extending essentially the entire length of the platform 41. A longitudinally extending drawer slide assembly 57 is mounted on the support frame 55. The drawer slide assembly 57 comprises an upper 59, a middle 61 and a lower slide 63, best seen in FIG. 3. The upper slide 59 is mounted in a fixed position on the support frame 55. As best seen in FIG. 3, the middle slide 61 is suspended below and is movable longitudinally with respect to the upper slide 59 by a plurality of equally spaced-apart v-guide rollers 65 mounted on the upper surface of the middle slide 61 that engage in v-guides 67 on the underside of the upper slide 59. A second series of evenly spaced-apart v-guide rollers 65 is mounted on the underside of the middle slide 61 and v-guides 67 on the upper surface of the lower slide 63 engage the v-rollers 65 on the underside of the middle slide 61 to suspend the lower slide 63 below the middle slide 61 and allow it to move longitudinally with respect to the middle slide 61. The lower slide 63 can move in either direction with respect to the middle slide 61, as can the middle slide 61 with respect to the upper slide 59. This enables the lower slide 63 to be extended from the platform 41 in either longitudinal direction.

Figure 3A:
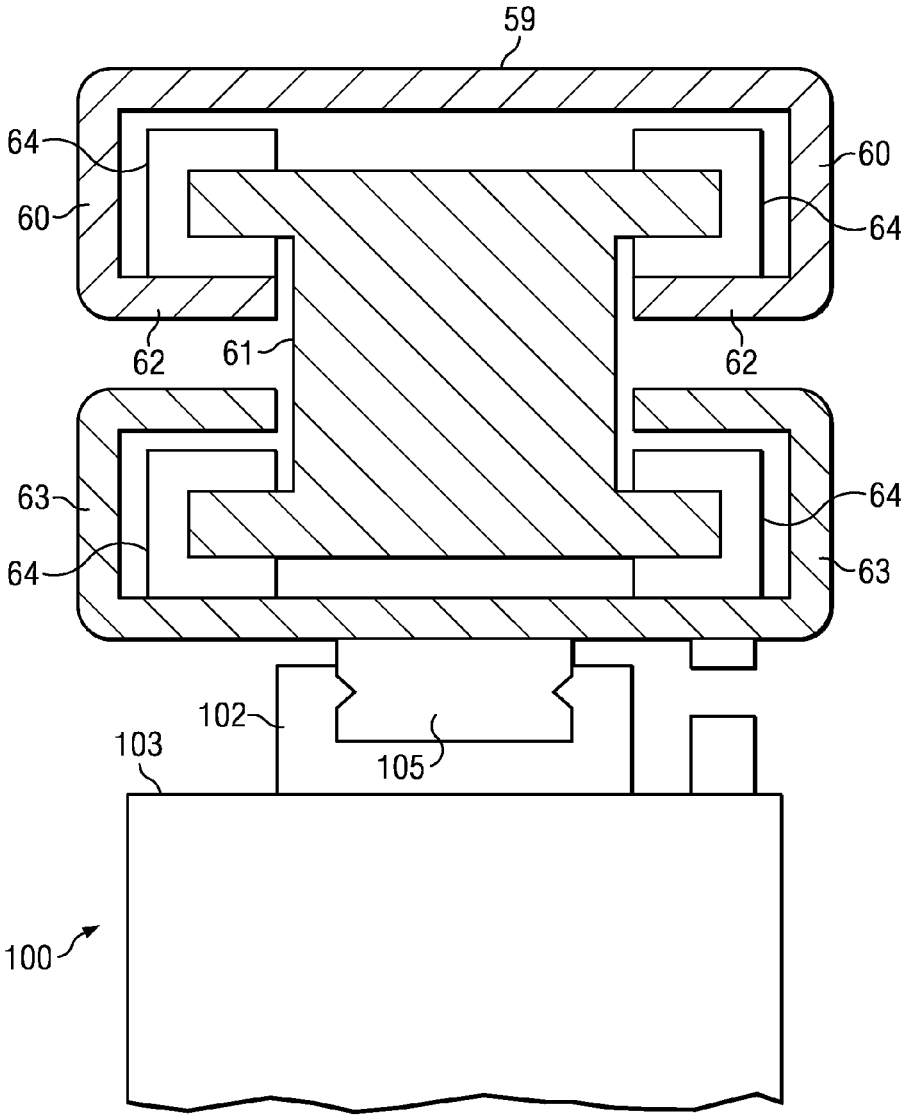
FIG. 3*a* is a vertical section through an alternative form of slide assembly.

Although the slide members 59, 61, 63 are interconnected in this example of the invention by v-rollers 65 and v-guides 67, other ways of slideably interconnecting the members 59, 61, 63 could be used. For example, as shown in FIG. 3*a*, in an alternative arrangement, the upper slide member 59 includes dependent side walls 60 with returns 62 forming a track on which the middle slide member 61 slides. In this arrangement, the middle guide is I shaped in vertical cross-section. A plastic guide 64 of low friction material covers the upper ends of the I and ensures free sliding motion between the upper and middle slides. A similar low friction plastic guide 64 is provided on the lower end of the I and facilitates sliding motion of the lower slide 63 with respect to the middle slide 61.

The relative movement of the slides 61 and 63 is controlled by left and right timing cables 69, 71. A first timing cable 69 is connected at 73 to the upper slide 59 near one of its ends and extends around a fixed pulley 75 on the side of the middle slide 61 and has its other end connected at 77 to the lower slide 63. The second timing cable 71 is attached at 79 near the other end of the upper slide 59, runs around a pulley 81 on the side of the middle slide 61 and is connected at its other end to the lower slide 63 at 83. The timing cables 69, 71 ensure that the middle slide 61 moves at half the speed of the lower slide 63 in each direction. Although in this form of the invention, the arrangement causes the middle slide 61 to move at half the speed of the lower slide 63, in other versions, the relative speed of movement could be different from 1:2, but still in a fixed ratio.

Figure 4:
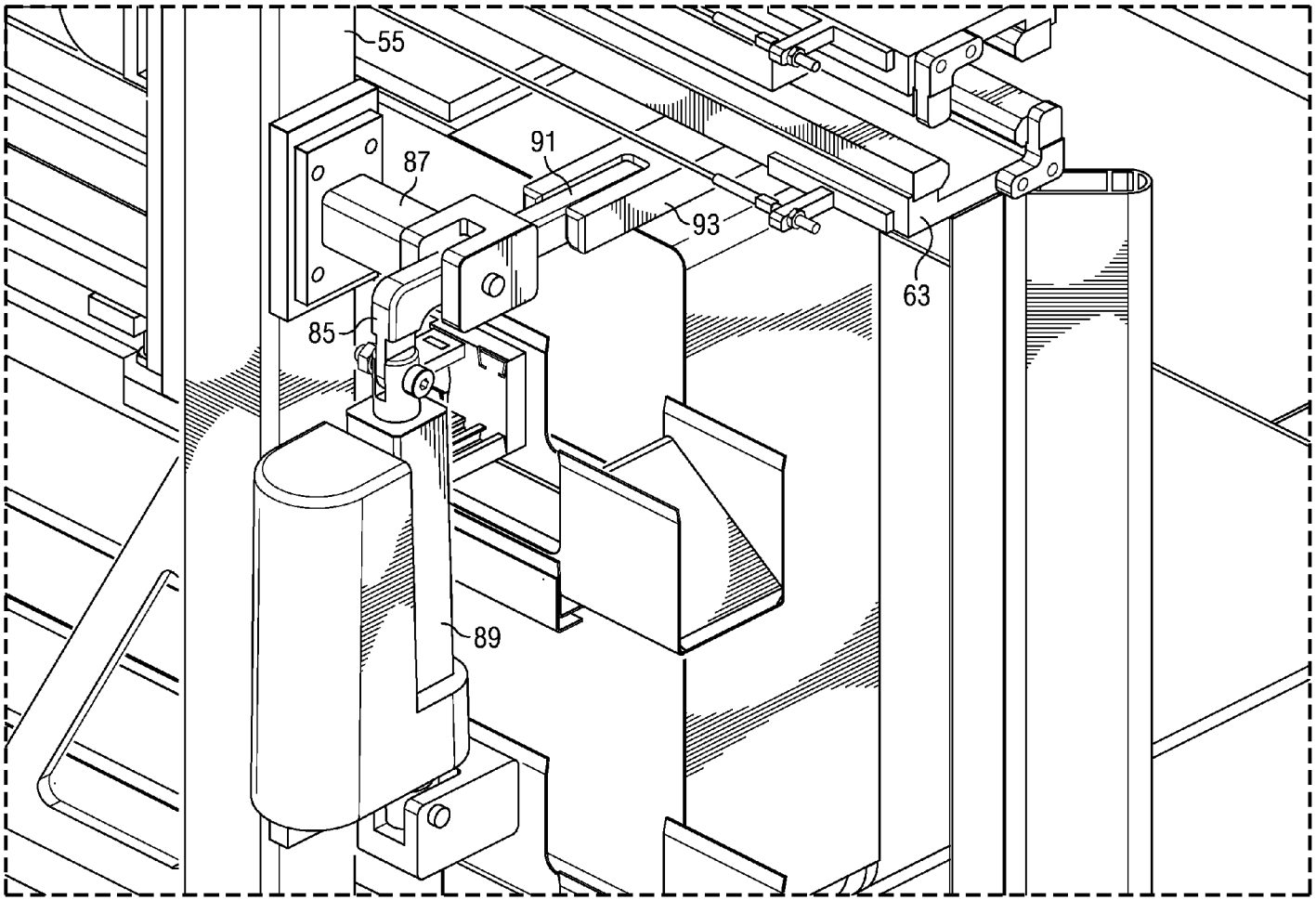
FIG. 4 is an isometric view of a mechanism for securing the slide assemblies in their home position.

The drawer slide assemblies 57 can be locked in a home position during movement of the platform 41. As best seen in FIG. 4, a home latch 85 is mounted on the support frame 55 by a bracket 87. An actuator 89 controlled by the control system for the mechanism is adapted to rotate the home latch 85 and move a free end 91 of the latch 85 into and out of engagement with a home latch receiver 93 fixed to an end portion of the lower slide 63. When the free end 91 is engaged in the latch receiver 93 the lower slide 63 and hence the entire drawer slide assembly 57 is held stationary with respect to the frame 55. The home position of the drawer slide assembly 57 is detected by means of two stationary encoders 95 on the upper slide 59. The encoders 95 read markings on a tape 97 carried by and extending along the middle slide 61.

Slideably mounted on each of the lower slides 63 is a pair of tractors 100. The tractors 100 are shown in FIGS. 5 through 10. Each tractor 100 includes an exterior housing 101. A pair of guide blocks 102 is provided on the upper surface 103 of the tractor housing 101 and engage with a guide rail 105 on the underside of the lower slide 63. The tractor 100 can be locked in a desired position on the lower slide 63 by means of an electric brake 107 on the upper surface 103. Each tractor 100 is individually driven by a respective servo motor 109 that drives a belt 111 that engages the surface below the tractor 100. When the brake 107 is engaged, as the tractor motor 109 drives the belt 111 to move the tractor 100, the lower slide 63 is moved with the tractor 100 and in the same direction. The drawer slide assembly 57 both guides and stabilizes the tractor 100 as it is deployed from the deck 42 to engage a vehicle and retracted to move the vehicle onto the deck 42. Each tractor 100 carries an encoder 112 enabling the position of that tractor 100 on the lower slide to be determined. This enables the mechanism to know that the pair of tractors 100 on each side of the deck 42 is positioned the correct distance apart to suit the wheelbase of the vehicle to be moved.

The independently operable motors 109 enable the tractors 100 to be moved independently and do not require that the two tractors on each side of the deck be positioned symmetrically with respect to the center of the deck 42. This enables the tractors to be positioned at a different position on the deck depending on the size of the vehicle to be moved. If the vehicle is small, the two tractors can be close to the front end of the deck, reducing the distance they have to travel to collect the vehicle and return with it to the deck 42. This reduces the time needed for that operation. If the vehicle to be moved is large and has a significant amount of its body behind the rear axle, the tractors 100 can be set with the necessary separation for wheelbase, but asymmetrically with respect to the center of the deck 42, allowing the entire body of the vehicle to be on the deck 42 when the lift 39 is moved vertically or horizontally.

As seen in FIG. 2, an obstruction detection device or bumper 113 is mounted on each end of each of the lower slides 63. The bumpers 113 consist of a vertically extending housing having a deflectable outer surface 114. When a bumper 113 encounters an obstruction, deflection of the outer surface 114 operates an interior switch which is connected to the control system for the device and is arranged to stop or reverse deployment of the drawer slide assembly 57 and tractors 100 if the bumper 113 comes into contact with an obstruction.

Figure 5:
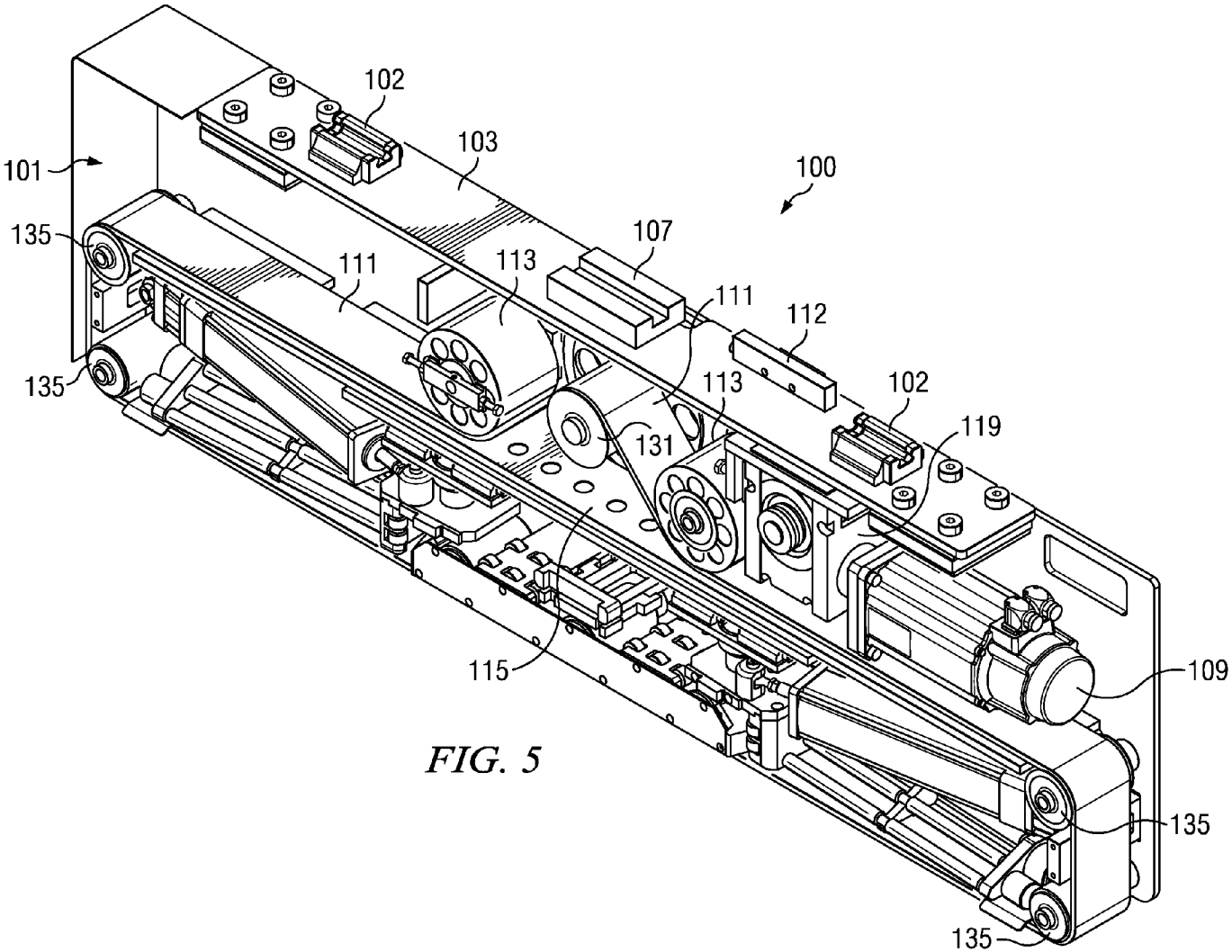
FIG. 5 is an isometric view of the inner side of one of the tractors with the inside cover plate removed to show interior detail.
Figure 6:
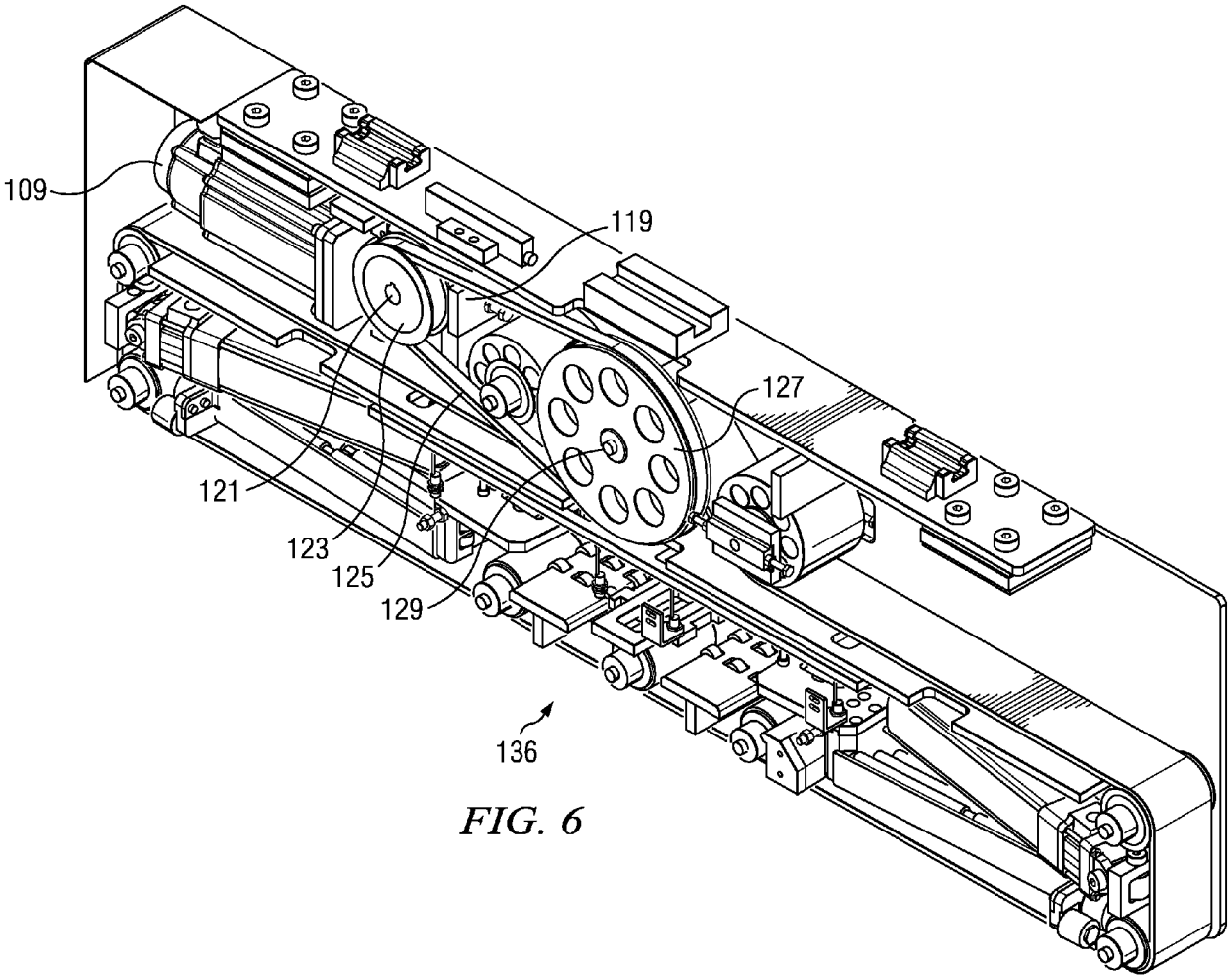
FIG. 6 is an isometric view of the tractor shown in FIG. 5 from the other side, with the outside cover plate removed to show interior detail.

Various supporting members are fixedly mounted within the tractor housing 101 to carry the components of the tractor 100. As best seen in FIGS. 5 and 6, the interior of the housing 101 is divided by a horizontal frame member 115 into upper and lower sections. The upper section houses the servo-motor 109 and other drive mechanisms for the tractor 100.

The servo-motor 109 drives a gearbox 119. A drive shaft 121 of the gearbox 119 turns a drive pulley 123 that is engaged by a belt 125 that in turn drives a pulley 127 on a shaft 129 that also carries a drive pulley 131 engaged with the drive belt 111. As seen in FIGS. 5 and 6, the drive belt 111 runs around rollers 113 in the upper section of the housing 101 and around four rollers 135 in the lower section of the housing 101. The rollers 135 are arranged in vertically spaced pairs at each longitudinal end of the housing 101. The lower roller 135 of each pair is so positioned at the bottom of the housing 101 that the belt 111 is in contact with the surface on which the tractor 100 is supported and can drive the tractor 100 over that surface. In alternative versions of the invention, the tractors 100 can be mounted on wheels or rollers in place of the belt 111.

Alternatively, the tractors 100 could be pushed and pulled off and on the deck 42 by means of a powered slide mechanism on the deck 42, as is described in the International Publication with respect to the under-vehicle dolly. The powered slide mechanism could be driven by cable, or by rack and pinion powered by one or more motors.

Each tractor 100 includes a lift arm assembly 136 located in the lower section of the housing 101 that can be deployed from the platform 41 by the tractors 100 to engage the tires of a vehicle, to lift the vehicle and to move it from a transfer room 45 or parking space 13 to the platform 41.

Figure 7:
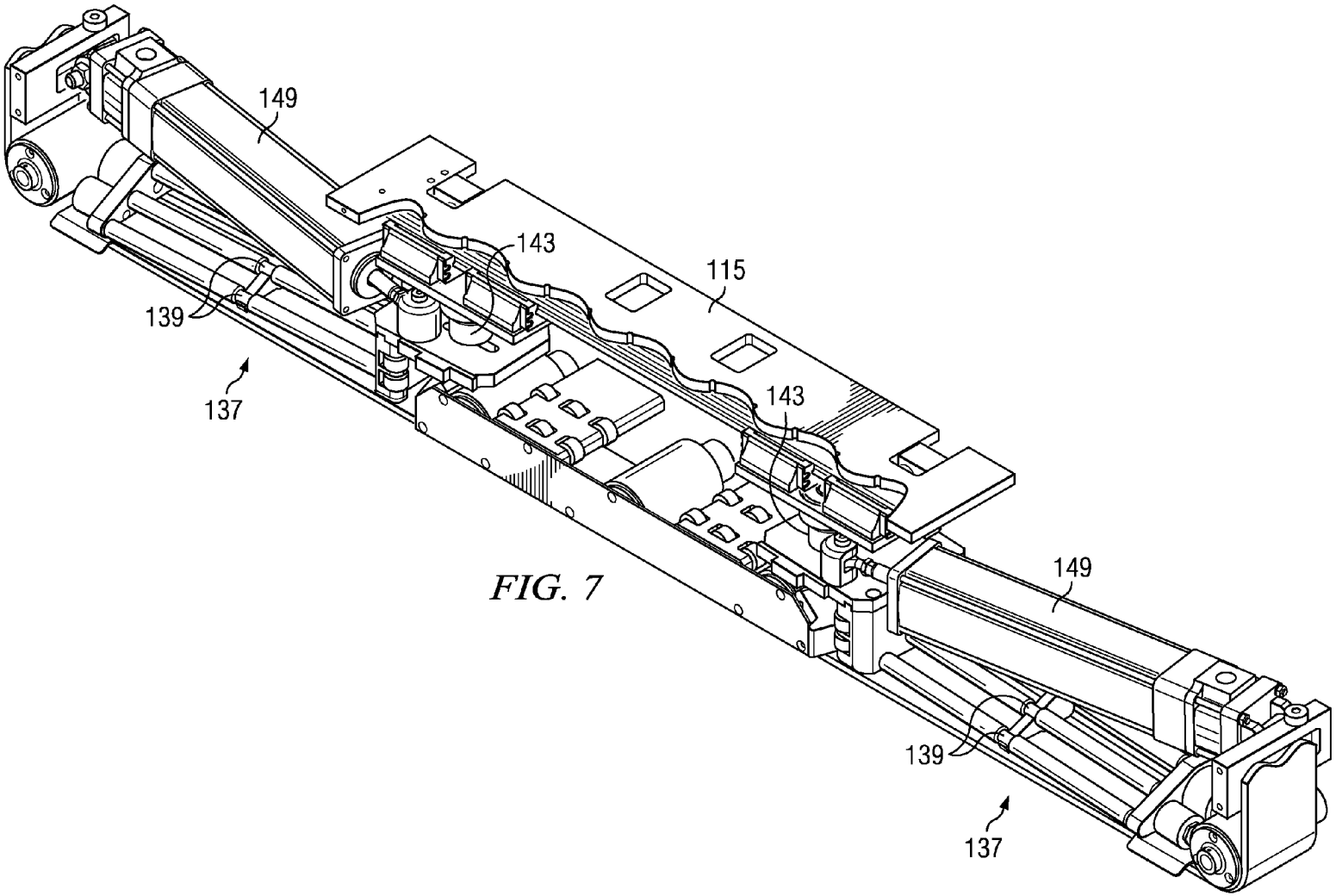
FIG. 7 shows an isometric view of one of the lift arm assemblies of the tractor shown in FIGS. 5 and 6 with the lift arms stowed in the tractor housing.
Figure 8:
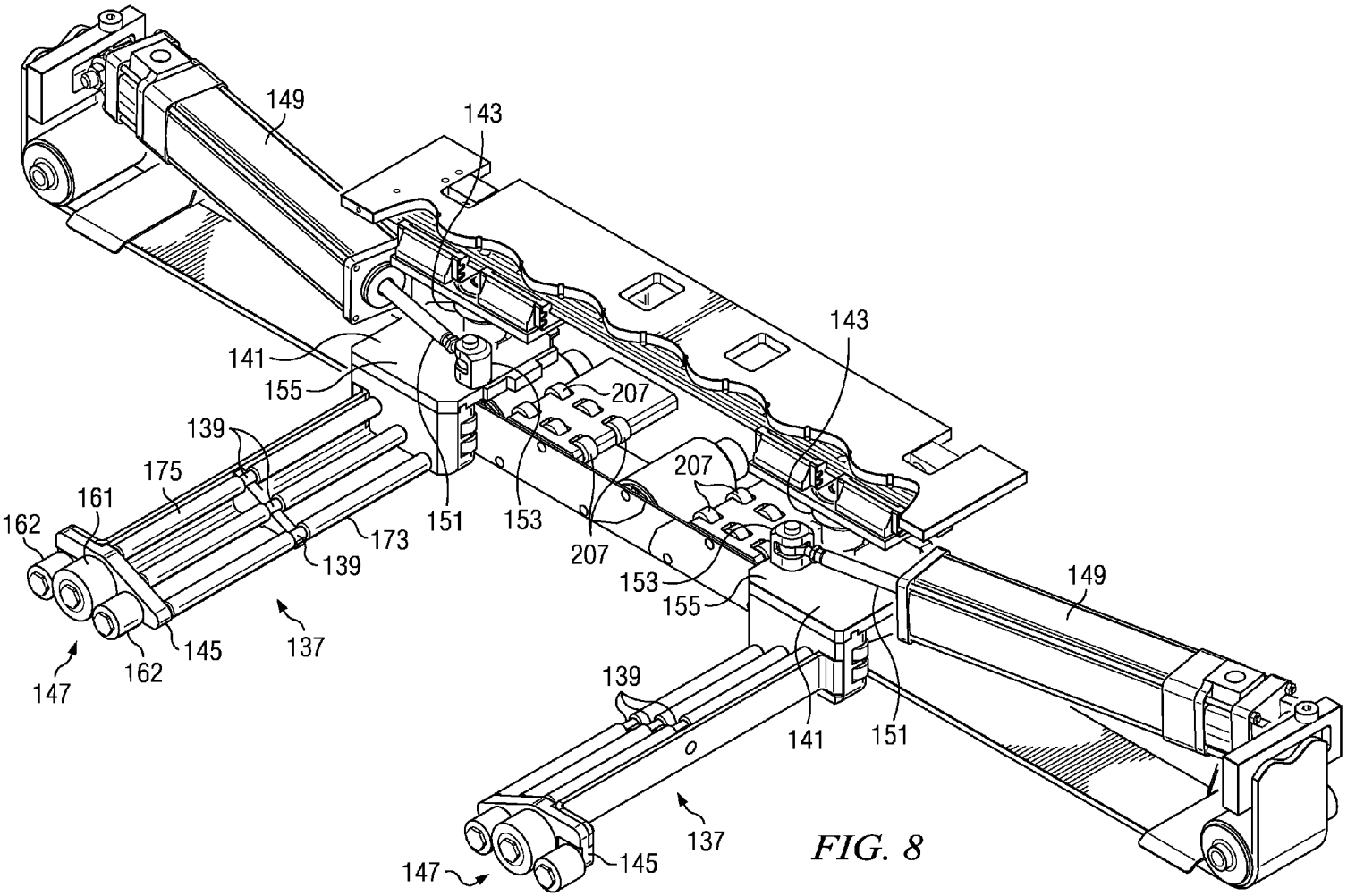
FIG. 8 shows an isometric view of the lift arm assemblies of FIG. 7 with the lift arms in the transverse position.

As best seen in FIGS. 7 and 8, each lift arm assembly 136 comprises an opposed pair of lift arms 137 that can be rotated between a folded position (seen in FIG. 7), in which they are stored in the housing 101 parallel to the longitudinal direction, and an open position (seen in FIG. 8) in which they are disposed essentially transverse to that longitudinal direction.

Each lift arm 137 comprises three lift roller assemblies 139 arranged in a wedge shaped manner and supported at one end in a lift arm support 141 that is capable of rotational motion about a vertical axis provided by a lift arm pivot 143. The support 141 is also movable longitudinally, so that the lift arms 137 operate with a compound motion, first rotating from the folded position to the transverse position, and then translating in a linear direction to engage the vehicle tires. At their other, distal, ends the roller assemblies 139 are supported by a support plate 145, on the outer side of which are mounted three surface-engaging support wheels 147 on which the lift roller assemblies 139 are moved towards and away from a tire.

Movement of the lift arm support 141 and accordingly of the roller assemblies 139 are controlled by a linear actuator 149. The body of the actuator 149 is connected at one end to the frame of the tractor housing 101 in a manner allowing both vertical and horizontal motion of the actuator 149. Shaft 151 of the actuator 149 is rotatably connected to a pivot pin 153 carried on the upper surface 155 of the lift arm support 141. As previously stated, the support 141 is mounted for rotation about a vertically extending lift arm pivot 143 mounted in upper 157 and lower 159 bearings secured to the upper surface of the lift arm support 141.

As seen in FIG. 8, the support wheels 147 consist of a larger center wheel 161 and two smaller outer wheels 162. The support wheels 147 are dimensioned so that their upper surface is below the plane defined by the lift roller assemblies 139. This allows the lift arms 137 to function even if the outer end of the lift arm roller assemblies 139 are not positioned beyond the tire to be lifted.

When in the transverse orientation shown in FIG. 8 the lift arm support 141 is movable in the longitudinal direction to bring the roller assemblies 139 of each opposed pair of lift arms 137 towards or away from each other to engage or release a vehicle tire. Longitudinal movement of the lift arm support 141 and lift arms 137 is provided by a linear guide assembly 163. The assembly 163 comprises a support plate 165 and a pair of guide blocks 167, one on each side of the upper bearing 157 of the lift arm pivot 143. The guide blocks 167 are slideably connected to a guide rail 169 mounted on and extending longitudinally along the underside of the frame member 115.

In operation, in order to pick up a vehicle from the transfer room or parking space, the tractors 100 must be deployed from the platform 41. During this deployment, the lift arm assemblies 136 are folded within the housing 101 of the tractor 100, so the tractors 100 may travel down the outside of the vehicle body. Once the tractors 100 are properly deployed, the lift arm assemblies 136 are operated and the lift arms 137 are rotated from the stowed position inside the housing 101 to the extended transverse position, under the vehicle and aligned to engage the vehicle tires. Thereafter, the opposed lift arms 137 are moved towards each other, causing the wedge-shaped, lift roller assemblies 139 to lift the tires and hence the vehicle, enabling it to be transferred from the transfer room 45 or parking space 13 to the platform 41.

Figure 13:
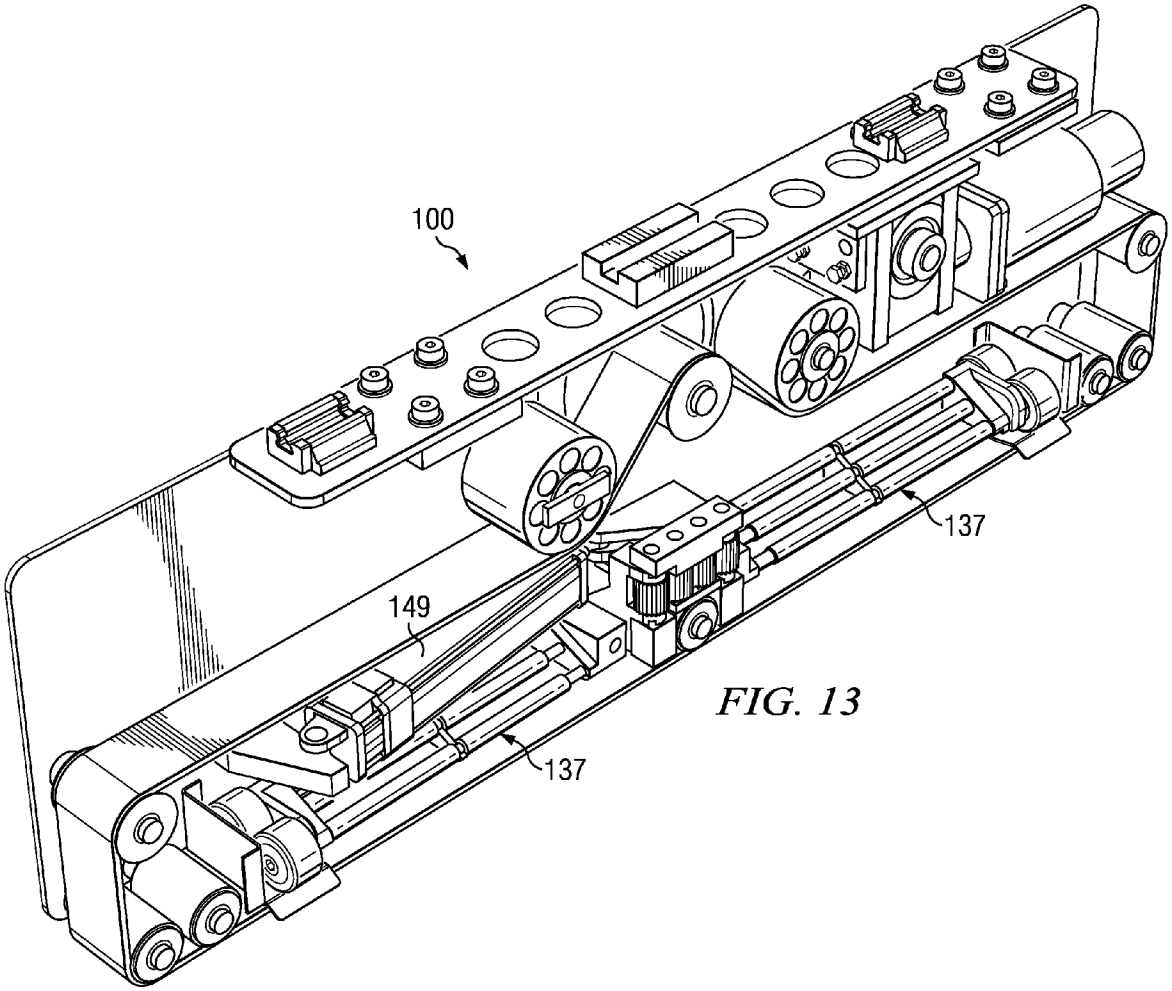
FIG. 13 is a side perspective of a second form of tractor that can be used in the invention showing the lift arms folded in the tractor housing.
Figure 14:
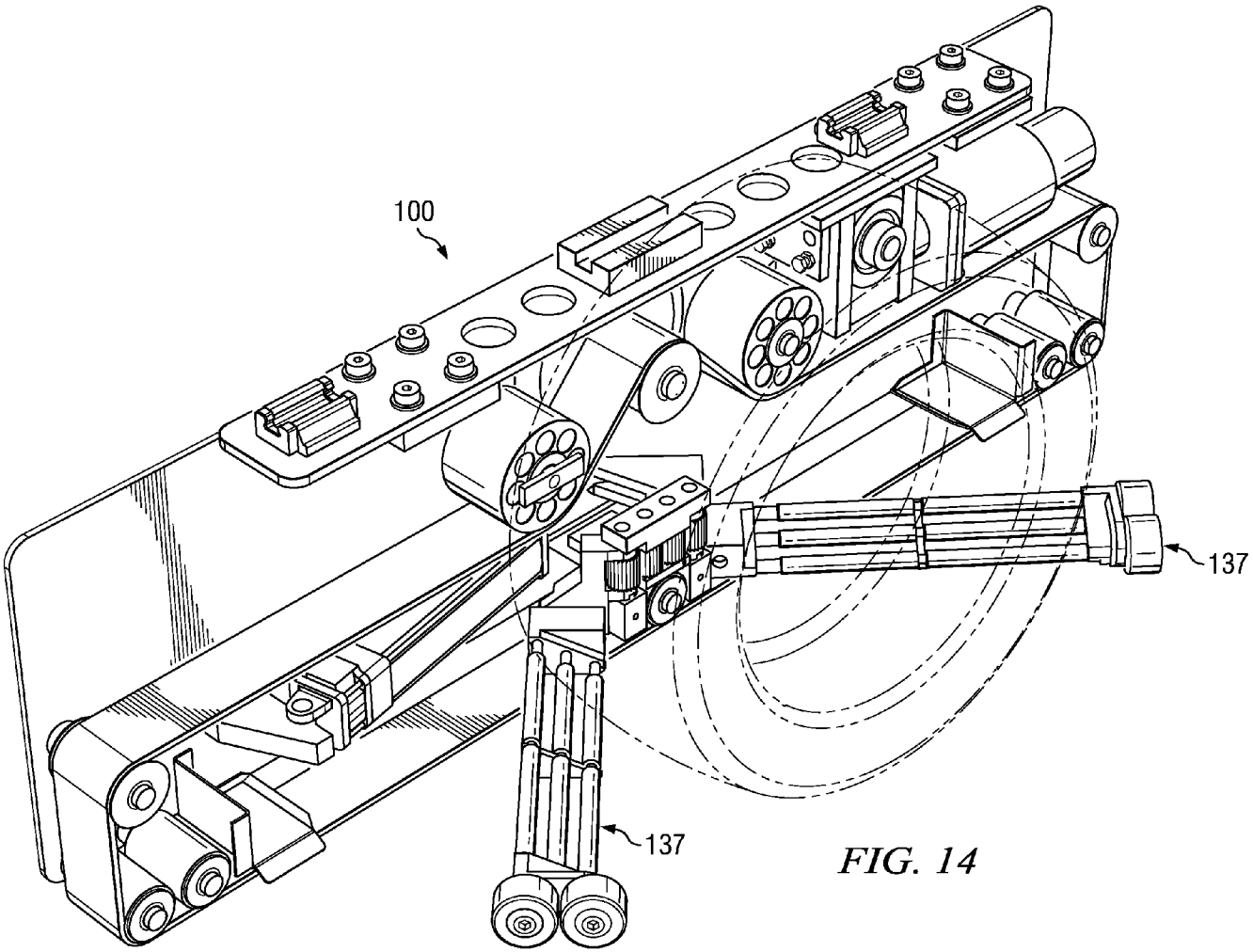
FIG. 14 is a side perspective of the tractor shown in FIG. 13 showing the lift arms unfolding to engage a vehicle tire.
Figure 15:
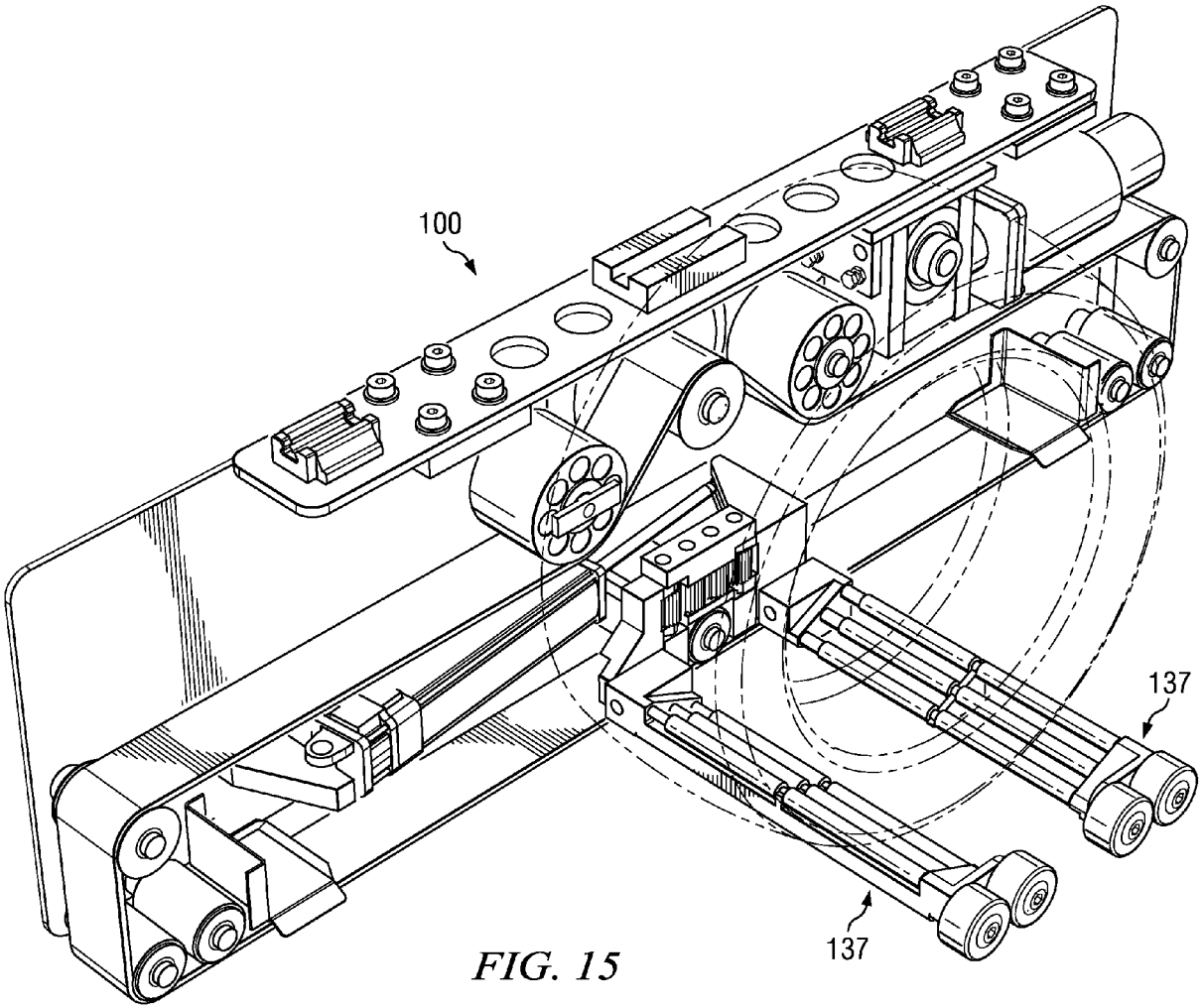
FIG. 15 is a side perspective of the tractor shown in FIG. 13 showing the lift arms engaging a tire.

In an alternative version of the tractor 100 shown in FIGS. 13 through 15, the lift arms 137 have only a rotational motion about a fixed pivot at their proximal ends. A disadvantage of a fixed pivot concept is that the motion of the arms 137, as they engage a tire, will impart a thrust into the tractor 100, the vehicle wheel or both. The pivot design is, however, simpler and less costly to produce than the compound motion arrangement. The pivot concept can use one actuator 149 to drive a pair of interconnected arms 137 to lift a vehicle tire for a total of 4 actuators per mechanism.

Figure 8A:
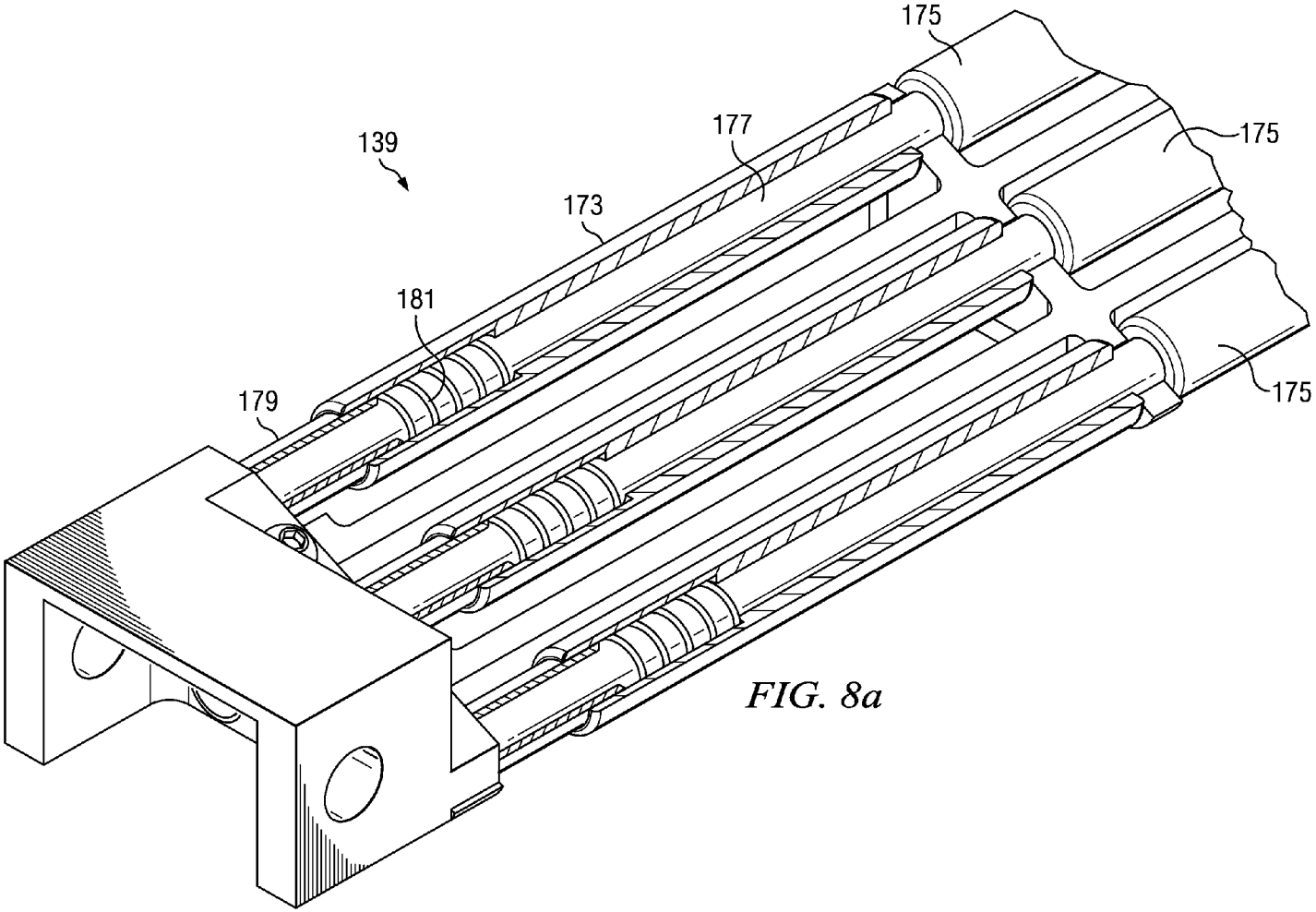
FIG. 8*a* is an isometric view of the lift roller assembly of the lift arm assembly shown in FIG. 8.

As best seen in FIG. 8*a*, each lift roller assembly 139 comprises an inner roller 173 and an outer roller 175 mounted on a support shaft 177. A spacer 179 is provided on the inner end of the shaft 177 and a coil spring 181 is accommodated within the roller 173. The inner end of the spring 181 acts against the outer end of the spacer 179 and the outer end of the spring 181 acts against an internal shoulder of the inner roller 173, as seen in FIG. 8*a*. The purpose of the movable inner roller 173 is to reduce thrust to the tractor 100 when the roller assemblies 139 come into lifting contact with a tire in order to lift a vehicle. At this time, the inner rollers 173 move inwardly and the force is absorbed in the coil springs 181. When the roller assemblies 139 are disengaged from the tire, the spring 181 returns the inner roller 173 to its original position. The construction of the roller assemblies 139 described above is particularly advantageous in forms of the invention such as the one shown in FIGS. 13-15, in which the lift arm assemblies 136 engage and lift the vehicle tire in a single rotational motion from the folded position to the transverse position, as opposed to the above described arrangement in which the arm assemblies are first opened to a full transverse position and then moved longitudinally to engage the tires.

Figure 9:
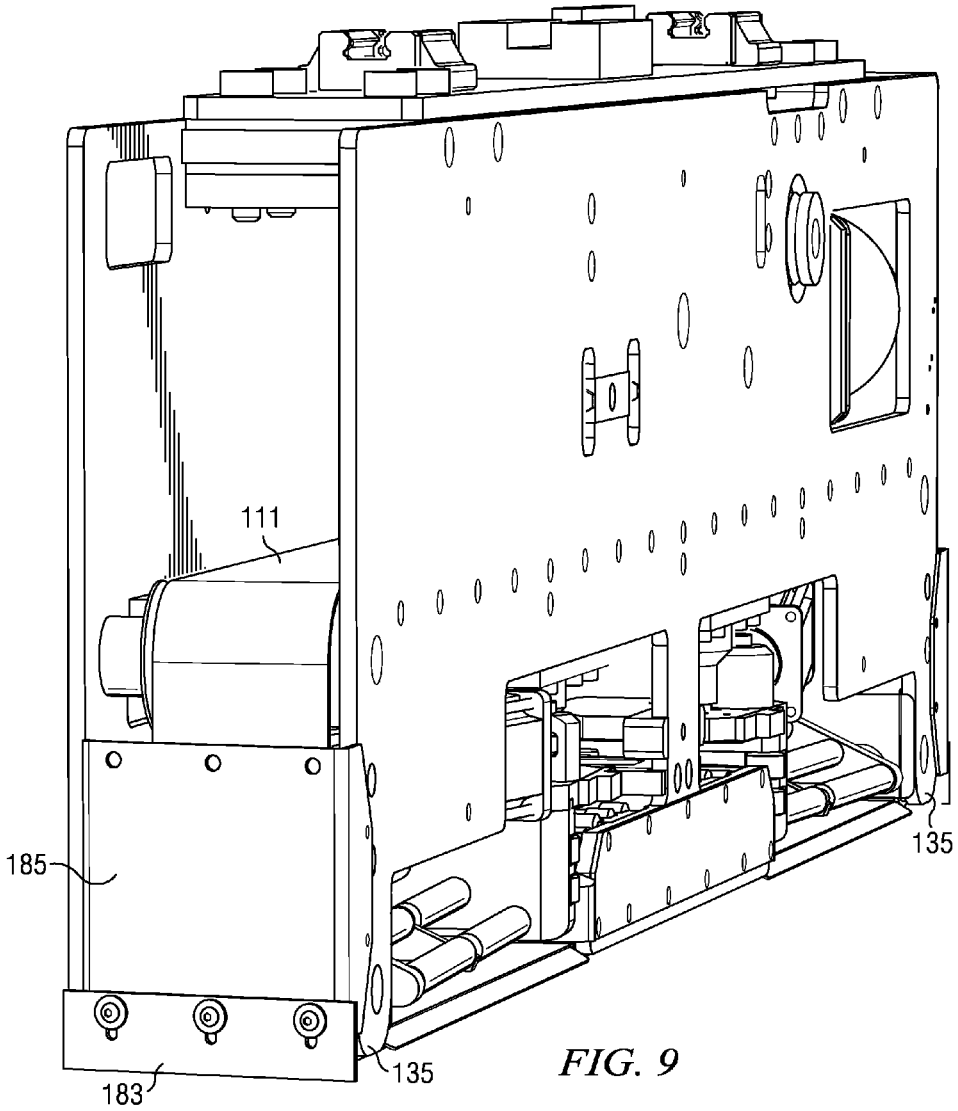
FIG. 9 is a perspective view of the tractor of FIG. 5 showing the debris sweeper.

The mechanism also includes a debris sweeper designed to reduce obstruction to movement of the tractors 100. As best seen in FIG. 9, a sweeper blade 183 is provided at each end of each tractor 100. The bottom of the blade 183 is in line with the bottom of the rollers 135 and the blade 183 is at an angle to the longitudinal direction so as to move debris, such as pebbles, ice, etc., outwardly so that it does not obstruct the movement of the tractor 100. Each sweeper blade 183 is mounted on a sweeper blade bracket 185 on the exterior of the tractor 100 in a manner that allows the vertical position of the blade 183 to be adjusted. The sweeper blade 183 could be spring-mounted on the tractor 100.

Both rotation and longitudinal motion of the lift arm assemblies 136 are powered by the linear actuators 149. In operation, rotation of the assemblies 136 occurs first and longitudinal motion thereof is prevented until the roller assemblies 139 are in the transverse position. In the folded condition of the lift arm assemblies 136, the lift arm support 141 is restrained from longitudinal movement by an anti-linear movement pin 187 on the upper end of the lift arm pivot 143 that engages in a bore 189 in the longitudinally extending guide rail 165. The pivot 143 is movable vertically in the bearings 157, 159 and includes a lift pin 191 extending horizontally from the pivot 143 in both directions and engaging a pair of ramps 193 in the upper lift arm bearing 157 as the pivot 143 rotates. This engagement causes the pivot 143 to move vertically as it rotates. During initial activation of the actuator 149, the strong force from the actuator 149 tries to move the lift arm support 141 longitudinally, but this movement is prevented by engagement of the anti-linear movement pin 187 in the bore 189. The force of the actuator 149 accordingly rotates the support 141 about the lift arm pivot 143, causing the lift arm assemblies 136 to be rotated outwardly. As the support 141 rotates, the lift pin 191 travels down the ramps 193, allowing the pivot 143 and the support 141 to move downwardly. After about 50° of rotation, the anti-linear movement pin 187 is disengaged from the bore 189.

The lowering of the pivot 143 and support 141 causes vertical downward movement of the lift arm assemblies 136 to bring them into engagement with the surface on which the tractor 100 is resting. When the rotation is reversed during stowing of the lift arm assemblies 136, the vertical upward movement raises the lift arm assemblies 136 so they can pass above the belt 111 and be accommodated within the housing 101 of the tractor 100, as shown in FIG. 5.

Figure 10:
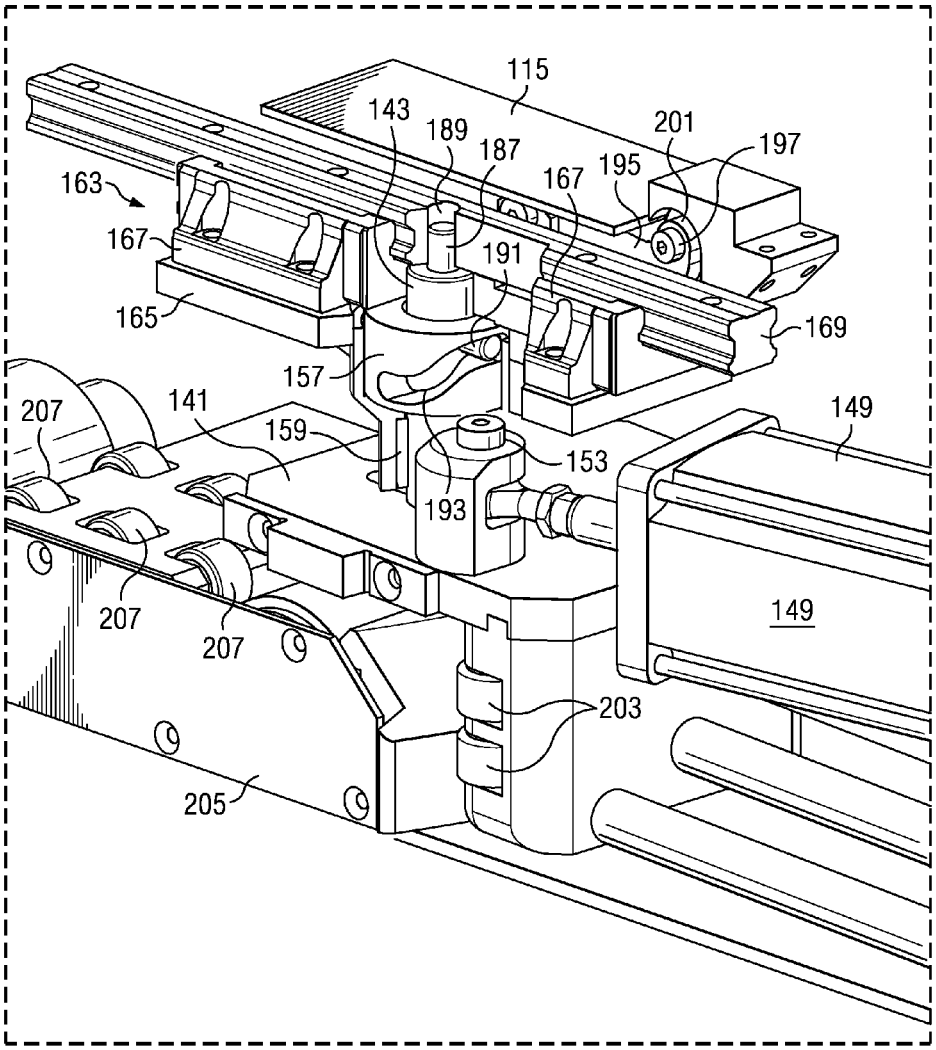
FIG. 10 is an isometric view of the mechanism for limiting rotational movement of the lift arms when the lift arms are completely folded.

After the anti-linear movement pin 187 is disengaged, linear movement of the lift arm support 141 and hence of the lift arm assemblies 136 is still initially prevented by a second retaining mechanism shown in FIGS. 9 and 10. The second mechanism comprises a pivoted latch arm 195. The arm 195 is pivotally connected at one end to the frame member 115. At its free end, the latch arm 195 carries a latch roller 197 which is biased by a latch spring into engagement with a detent 201 extending from the frame member 115. This engagement prevents longitudinal movement of the linear guide assembly 163 on the guide rail 169, but allows the lift arm assemblies 136 to rotate to the transverse position.

When the transverse position is achieved, further rotation of the lift arm support 141 is prevented by anti-rotation rollers 203 on the support 141 which engage a wear plate 205 forming part of the frame. At this time, the linear actuator 149 has sufficient force to overcome the bias of the latch spring, releasing the latch roller 197 from the detent 201 and freeing the linear guide assembly 163 for longitudinal movement on the guide rail 169 so that the lift arm assemblies 136 can move longitudinally to engage the tires.

As the lift arm support 141 moves longitudinally to bring the lift roller assemblies 139 into engagement with the tire, the horizontal surface of the support 141 runs over and depresses three pairs of load transfer rollers 207 mounted on the frame of the tractor 100 that transfer the load of the vehicle to the belt 111 for increased traction during the transportation of the vehicle on or off the platform 41.

As previously described, each of the tractors 100 is driven by a respective motor 109 and can be moved individually along its supporting lower slide 63. This enables the distance between the two tractors 100 on each side of the platform to be adjusted to match the wheel base of the vehicle. This adjustment is preferably carried out during the time the lift 39 is traveling to a parking space 13 or a transfer room 45 to pick up a vehicle. At that time the drawer slide assembly 57 is locked as described above to prevent relative movement of the upper, middle and lower slides 59, 61, 63. A control system for the mechanism transmits a signal corresponding to the previously determined wheel base of the vehicle to be transported to the servo-motors 109 which adjust the relative position of the pair of the tractors 100 on each lower slide 63 to match the tire wheel base. The electric brakes 107 are then engaged to hold the tractors 100 in the desired position on the lower slides 63. Once the correct adjustment for wheel base is achieved, the drawer slide assembly 57 is unlocked to allow deployment of the tractors 100.

Alternatively, sensors may be mounted on the tractors 100 to determine and adjust to the wheelbase of the vehicle as the tractors 100 move past the vehicle during their deployment.

A magnetic strip 209 is located on the middle slide 61 and the position of this strip 209 is detected to ascertain the position of each of the middle slides 61 to ensure the two slide assemblies are correctly positioned with respect to each other when the tractors 100 are deployed.

In use, horizontal motion of the vehicle transporter 15 can occur simultaneously with the vertical and horizontal motion of the platform 41 and rotation of the platform 41. Similarly, the adjustment of the relative spacing of tractors 100 can be adjusted for wheel base before the platform 41 reaches the location at which a vehicle is to be picked up.

In addition to adjusting the distance between the two tractors 100 on each side of the platform 41 to match the wheel base of the vehicle, the tractors 100 must be within a certain distance of the sides of the vehicle for the lift arm assemblies 136 to function properly. The mechanism accordingly includes an arrangement that permits the transverse distance between the tractors 100 on the left and right side of the vehicle-carrying deck 42 to be adjusted. This can be done simultaneously with the vertical and horizontal of the platform 41.

Figure 11:
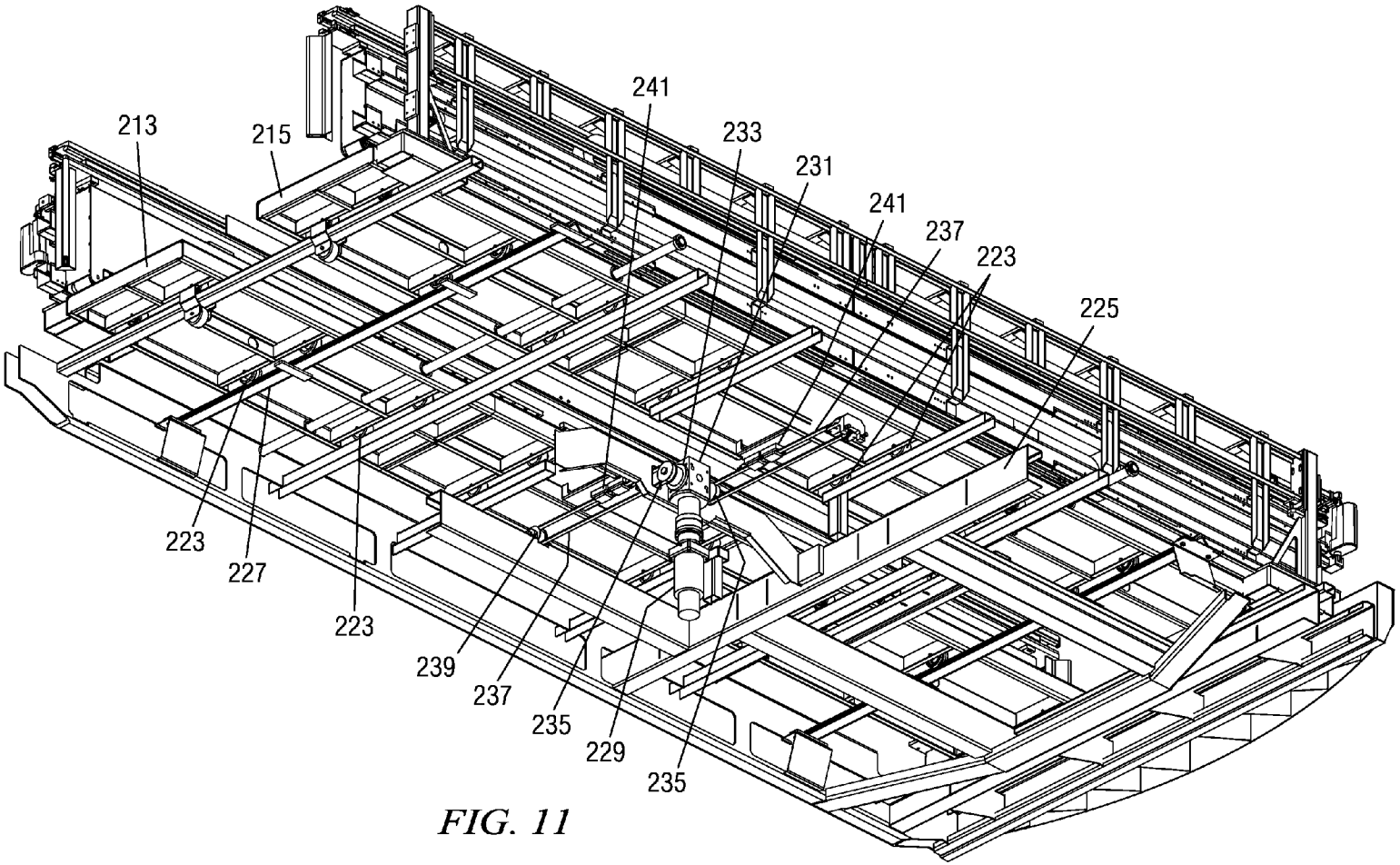
FIG. 11 is an isometric view from below showing the mechanism for moving the two decks and associated tractors and slide assemblies transversely.
Figure 12:
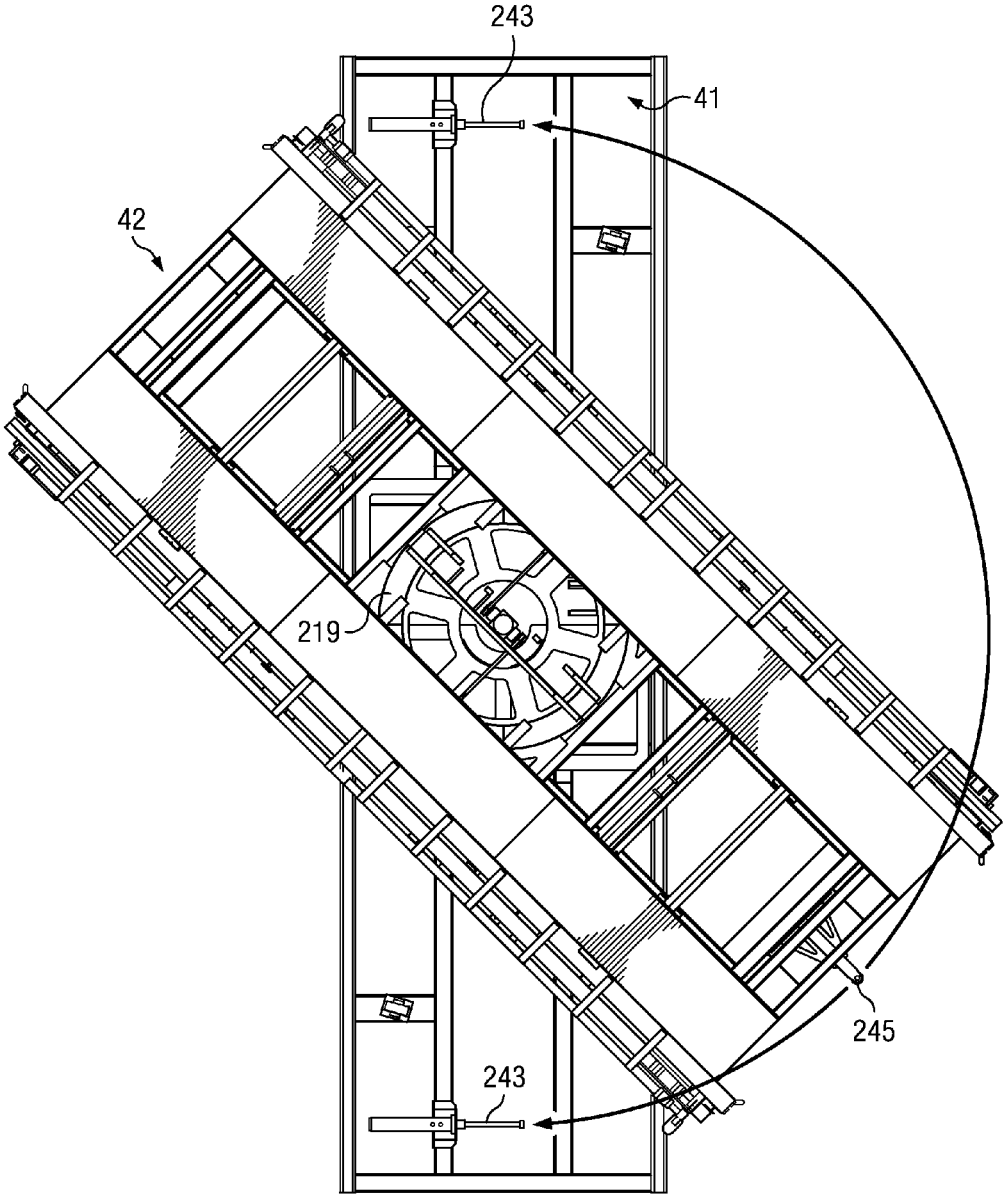
FIG. 12 is an isometric view from above showing the vehicle-carrying-deck and platform and the associated backlash control mechanism.

As best seen in FIGS. 11, 12 and 13, the deck 42 includes separate left and right decks 213, 215 respectively. The deck 42 is rotatably mounted on a platform 41 by an externally geared bearing 219. The bearing 219 is driven by a pinion mounted to a servo-motor 221 carried on the platform 41. The left and right decks 213, 215 are supported by rollers 223 on a frame 225 of the deck 42. Some of the rollers 223 have v grooves to maintain alignment and travel in transversely extending horizontal beams 227 supported by the frame 225. Also carried by the frame 225 is a servo-motor 229 which drives a gearbox 231 which powers a counter-rotating dual output shaft 233. On each end of the shaft 233 is a drive pulley 235 that engages a timing belt 237 that extends from the pulley 235 and around a timing belt roller 239 secured to the underside of the frame 225. The decks 213, 215 are connected to the respective timing belts 237 by releasable attachments 241 on the underside of the decks 213, 215. Operation of the servo-motor 229 causes the timing belts 237 to move the decks 213, 215 transversely on their rollers 223 towards or away from each other, adjusting the distance between the left and right side pairs of tractors 100, which are mounted on the respective decks 213 and 215.

In use, when a vehicle enters the transfer room 45, scanners determine the vehicle's length, width, height and wheel base. Width data is fed to the servo-motor 229 and the counter-rotating dual output shafts 233 engage the timing belts 237 attached to each deck 213, 215 to change the transverse spacing between the left and right side tractors 100. A brake on the servo-motor 229 maintains the correct spacing of the decks 213, 215 during operation of the lift arm assemblies 136.

As will be appreciated by those skilled in the art, there is normally backlash allowing relative movement between the pinion and geared bearing 219 which prevents accurate prediction of the exact position of the deck 42 at the end of rotational movement. This backlash has to be eliminated to increase the accuracy with which rotation of the vehicle-carrying deck 42 can be controlled. The servo-motor 221 uses an encoder (not shown) to control the rotational position of the deck 42. A pair of backlash control springs 243 are mounted on the platform 41 and positioned to contact to a backlash control arm 245 extending from one end of the deck 42. When the deck 42 approaches the end of its rotational travel, the backlash control arm 245 comes into contact with one of the backlash control springs 243 which pushes on the deck 42 to ensure contact between the pinion and the geared bearing 219, thus eliminating any backlash. Once the deck 42 is in the desired position, a brake on the motor 221 holds it in that position.

As in the dolly disclosed in the International Publication, the vehicle transfer mechanism 43 benefits from allowing the "tilt" angle of the lift 39 to be adjusted to match the floors in the parking structure 11 to facilitate movement of a vehicle between the deck 42 and a parking space 13. In the International Publication, the tilting is accomplished by a separate mechanism placed between the horizontally fixed lower portion of the platform and the rotary deck. The present embodiment eliminates the need for a separate tilting mechanism by using the chains 47 and associated motors that raise and lower the platform 41. One end of the lift platform 41 can be moved more or less than the opposing end thus achieving the desired tilt angle without the need for a separate mechanism. This improvement saves cost, weight and cycle time.

Although the motors in the preferred embodiment are servo motors, other types of motors could be used, for example AC induction motors or other commercially available motors.

The invention claimed is:

1. Apparatus for transporting a vehicle between a lift platform and a parking space of a parking structure comprising four tractors, two on each side of the platform, adapted for motion between the platform and the parking space, each tractor carrying a pair of opposed tire engaging lift arms adapted to engage a tire of the vehicle to be transported and to lift the vehicle for movement to or from the platform or parking space, the tractors being arranged to pass outside the tires of the vehicle with the lift arms in a folded condition and then to extend the arms to engage and lift a respective tire, wherein the proximal ends of the lift arms are mounted on a lift arm support that is rotatable about a vertical axis to fold and unfold the arms and movable longitudinally to move the arms into and out of engagement of the vehicle tire, the lift arm support being connected to a shaft of a linear actuator mounted on the associated tractor, a housing being restrained against longitudinally motion upon initial extension of the actuator, causing the support to rotate to unfold the lift arms, and wherein unfolding of the lift arms frees the lift arm support for longitudinal motion to move the lift arms into engagement with a vehicle tire.

2. Apparatus as claimed in claim 1 wherein each of the tractors is driven by a motor individual to that tractor.

3. Apparatus as claimed in claim 1, wherein the pairs of tractors on opposite sides of the platform can be moved laterally with respect to each other whereby the lateral separation between the pairs of tractors can be adjusted to suit the track size of the vehicle to be moved.

4. Apparatus as claimed in claim 1, wherein each of the tractors on a side of the platform is independently mounted on a respective extensible slide assembly which guides the tractors when they are deployed from the platform.

5. Apparatus as claimed in claim 4, wherein each slide assembly comprises an upper slide member, a middle slide member and a lower slide member, the upper slide member being fixed on the platform, the middle slide member being mounted on and movable longitudinally in both directions with respect to the upper slide member and the lower slide member being mounted on and movable longitudinally in both directions with respect to the middle slide.

6. Apparatus as claimed in claim 5, including a timing mechanism interconnecting the slide members of each slide assembly and controlling the relative rate motion of the slide members.

7. Apparatus as claimed in claim 6, wherein the timing mechanism is a cable mechanism.

8. Apparatus according to claim 1 wherein the tractors are connected to a powered slide mechanism that is driven to move the tractors on and off the platform.

9. Apparatus as claimed in claim 1, wherein each lift arm comprises a plurality of rollers arranged to present a wedge-shaped contact surface for engaging the vehicle tire, the free ends of the rollers being supported on a wheeled frame, the lower vertical dimension of the frame and wheels being below the plane defined by the roller array.

10. Apparatus as claimed in claim 1, as wherein the distance between the pairs of tractors on either side of the platform can be adjusted to suit the track of the vehicle.

11. Apparatus for transporting a vehicle between a lift platform and a parking space of a parking structure comprising four tractors, two on each side of the platform, adapted for motion between the platform and the parking space, each tractor carrying a pair of opposed tire engaging lift arms adapted to engage a tire of the vehicle to be transported and to lift the vehicle for movement to or from the platform or parking space, the tractors being arranged to pass outside the tires of the vehicle with the lift arms in a folded condition and then to extend the arms to engage and lift a respective tire, wherein the proximal ends of the lift arms are mounted on a lift arm support that is rotatable about a vertical axis to fold and unfold the arms and movable longitudinally to move the arms into and out of engagement of the vehicle tire, the lift arm support being connected to a shaft of a linear actuator mounted on the associated tractor, a housing being restrained against longitudinally motion upon initial extension of the actuator, causing the support to rotate to unfold the lift arms, and wherein the lift arm support is adapted to move vertically during the folding and unfolding of the lift arms so that in the folded position the arms are raised above the level of the bottom of the tractor and in the perpendicular position the arms are lowered so that rollers supporting the distal end of the arms engage the platform or parking space surface.

* * * * *